United States Patent [19]

Defago et al.

[11] 4,093,415

[45] June 6, 1978

[54] TRANSFER PRINTING PROCESS FOR HYDROPHILIC, SYNTHETIC FIBRE MATERIAL OR MIXTURES OF HYDROPHILIC AND SYNTHETIC FIBRE MATERIAL

[75] Inventors: Raymond Defago, Riehen; Zdenek Koci, Binningen, both of Switzerland

[73] Assignee: Ciba Geigy AG, Basel, Switzerland

[21] Appl. No.: 594,077

[22] Filed: Jul. 8, 1975

[30] Foreign Application Priority Data

Jul. 12, 1974 Switzerland ..... 9638/74

[51] Int. Cl.[2] ..... D06P 5/00; C09D 11/00

[52] U.S. Cl. ..... 8/2.5 A; 8/1 W; 8/21 C; 8/39 C; 8/41 C; 8/54; 8/54.2; 8/85 B; 8/88; 8/172 R; 8/173; 106/22

[58] Field of Search ..... 8/2.5, 2.5 A, 85 B, 8/88, 54, 54.2, 21 C, 1 W, 172 R, 173, 2.5 R; 106/22

[56] References Cited

U.S. PATENT DOCUMENTS

| | | | |
|---|---|---|---|
| 2,225,604 | 12/1940 | Lubs et al. | 8/85 |
| 2,290,945 | 7/1942 | Dahlen et al. | 8/62 |
| 2,526,948 | 10/1950 | Himel | 117/138.5 |
| 2,928,712 | 3/1960 | Bradshaw | 8/85 |
| 3,265,461 | 8/1966 | Luetzel et al. | 8/84 |
| 3,536,490 | 10/1970 | Hochberg | 8/2.5 A |
| 3,536,699 | 10/1970 | von Brachel et al. | 260/239.3 |
| 3,623,834 | 11/1971 | Seuret et al. | 8/172 |
| 3,666,397 | 5/1972 | Datye et al. | 8/2.5 |
| 3,706,525 | 12/1972 | Blackwell et al. | 8/21 C |
| 3,995,992 | 12/1976 | Defago et al. | 8/2.5 R |

FOREIGN PATENT DOCUMENTS

| | | |
|---|---|---|
| 813,881 | 10/1974 | Belgium. |
| 2,045,465 | 6/1971 | Germany. |
| 2,300,237 | 7/1973 | Germany. |
| 2,456,637 | 6/1975 | Germany. |
| 729,643 | 5/1955 | United Kingdom. |

OTHER PUBLICATIONS

V.S. Salvin, American Dyestuff Reporter, Jun. 5, 1967, pp. 31–35.

E.J. Blanchard et al., American Dyestuff Reporter, Jul. 1976, pp. 32–34, 65.

Rattee & Breuer, "The Physical Chemistry of Dye Adsorption" (Academic Press, 1974) pp. 133–136.

*Primary Examiner*—A. Lionel Clingman

*Attorney, Agent, or Firm*—Wenderoth, Lind & Ponack

[57] ABSTRACT

Transfer printing process for dyeing or optical brightening of hydrophilic fibre material, synthetic fibre material, or mixtures of hyrophilic and synthetic fibre material with transferable dyestuffs or optical brighteners, characterized in that for dyeing or optical brightening inert temporary carriers are used which are treated with at least one transferable dyestuff or optical brightner, at least one solid compound which melts during the heat exposure of the transfer process and has a vapor pressure above $10^{-5}$ mm Hg at 150° to 250° C and, optionally, a binder which is stable below 230° C.

22 Claims, No Drawings

TRANSFER PRINTING PROCESS FOR HYDROPHILIC, SYNTHETIC FIBRE MATERIAL OR MIXTURES OF HYDROPHILIC AND SYNTHETIC FIBRE MATERIAL

It is known to produce transfer prints on woven textile fabrics or knitted textile fabrics by printing a carrier material, usually paper, with an aqueous or, preferably, with an organic practically anhydrous, printing ink containing sparingly water-soluble sublimable disperse dyestuffs and then pressing the printed paper against the woven textile fabric or knitted textile fabric which is to be printed and heating it to a temperature at which the dyestuff sublimes, passes over onto the woven fabric or knitted fabric and diffuses into the fibres. Using this so-called transfer printing process it is possible to produce both plain colour prints and complicated patterns, without requiring expensive printing machinery at this stage.

Corresponding processes are known, for example, from French Patent Specifications No. 1,223,330 and 1,334,829 and Swiss Patent Specification No. 476,893. However, all these processes relate to printing on hydrophobic synthetic fibres, such as cellulose acetate, synthetic polyamides, acrylonitrile and especially polyesters. Since the sublimable disperse dyestuffs hitherto used for transfer printing have no affinity, or at most a slight affinity, to hydrophilic fibres, especially to cotton and regenerated cellulose fibres, the transfer printing processes mentioned solely produce pale unusable prints on these materials.

Belgian Patent No. 813 881 describes a transfer printing process for printing textiles of cellulose and other polyhydroxylic fibres, using sublimable organic dyestuffs or brighteners, wherein the material to be printed is impregnated with an aqueous solution of at least one organic compound which a) has a boiling point above 120° C, b) is soluble to the extent of at least 25 g/l in water at 25° C, either directly or with the aid of an auxiliary solvent, and c) is of low volatility, but liquid, and does not decompose, under the condition of transfer of the dyestuffs or brighteners. This process has the disadvantage that the substrate to be printed must be pre-treated before printing or dyeing.

Further, Belgian Patent No. 822 832 describes a transfer printing process which permits dyeing and brightening hydrophilic fibre material, especially cotton and wool, with transferable dyestuffs for optical brighteners by the transfer printing process, by using inert temporary carriers, so-called auxiliary carriers, which are treated with at least one transferable dyestuff or optical brightener and optionally a binder which is stable below 230° C, and additionally a) also with at least one compound which eliminates water during the heat exposure of the transfer printing process and is thereby converted to a compound which has a vapour pressure above $10^{-5}$ mm Hg at 100° to 250° C, or b) also with at least one compound which eliminates water during the heat exposure of the transfer process together with at least one compound which has a vapour pressure above $10^{-5}$ mm Hg at temperatures of 100° to 250° C.

Accordingly, the basis of this process is a bifunctional transfer auxiliary system.

A process has now been found which permits, simply and in a surprising manner, and whilst avoiding expensive pre-treatments, deep and fast dyeing or brightening of a hydrophilic substrate which is to be dyed or printed, especially cotton and wool, with the aid of an only monofunctional transfer auxiliary and with transferable dyestuffs or optional brighteners, in accordance with the transfer printing process. The new process is characterised in that inert temporary carriers, so-called auxiliary carriers, are used, which have been treated with at least one transferable dyestuff or optical brightener and, optionally, a binder which is stable below 230° C, and additionally also with at least one solid compound which melts during the heat exposure of the transfer printing process and has a vapour pressure above $10^{-5}$ mm Hg at 150° to 250° C.

The new process is not only suitable for dyeing, printing and optical brightening of hydrophilic fibre material but also of synthetic fibre material and especially of mixtures of hydrophilic and synthetic fibre material.

Particularly suitable compounds which accord with the definition and can be used according to the invention are above all those which contain at least one nitrogen atom in the molecule, such as, for example, amides, imides, unsubstituted and substituted ureas and thioureas and also 5-membered or 6-membered saturated or unsaturated heterocyclic ring compounds which contain at least one of the groups or atoms N, S, O, NH, CO, =CH or $CH_2$ as ring members and which can be substituted by alkyl ($C_1$–$C_4$), OH, $NH_2$, hydroxyalkyl ($C_1$–$C_3$) or halogen.

The following may be mentioned specifically: imidazole, 2-methylimidazole, hydantoin, 1-N-hydroxymethyl-5-dimethylhydantoin, succinimide, N-hydroxysuccinimide, nicotinic acid amide and pyrazinecarboxylic acid amide.

Preferred urea and thiourea derivatives are derived from compounds of the following general formula 1:

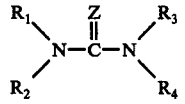

(1)

wherein Z = O or S and $R_1$, $R_2$, $R_3$ and $R_4$ independently of one another denote H, alkyl ($C_1$–$C_8$), cycloalkyl or aryl, especially phenyl or o-, m- or p-tolyl, which can optionally be substituted by OH, CN, $NH_2$, halogen or hydroxyalkyl ($C_1$–$C_3$).

If $R_1$ to $R_4$ each denote an alkyl radical, these can be straight-chain or branched, or $R_1$ and $R_2$, or $R_3$ and $R_4$, together with the nitrogen atom to which they are bonded, or $R_1$ and $R_3$, or $R_2$ and $R_4$, together with the bridge member N—CZ—N— to which they are bonded, can form a heterocyclic ring which optionally contains further hetero-atoms such as, for example, oxygen, sulphur or nitrogen atoms. These alkyl radicals can also be substituted, for example can contain aryl radicals, and in that case are, for example, a benzyl radical.

If $R_1$ and $R_2$, or $R_3$ and $R_4$, form a heterocyclic ring with the nitrogen atom to which they are bonded, then compounds of the formula 2

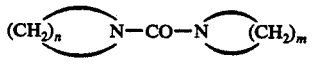

(2)

or "mixed" ureas of the formula 3

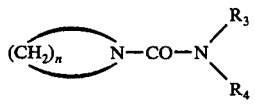

(3)

are of particular interest; in these, $n$ and $m$ denote positive integers from 2 to 6 and $R_3$ and $R_4$ each denote an alkyl radical. Compounds of the formulae 2 and 3 can contain, for example, aziridine, pyrrolidine, piperidine or hexamethyleneimine radicals bonded to the carbonyl bridge. If the heterocyclic ring formed by $R_1$ and $R_2$, or $R_3$ and $R_4$, with the nitrogen atom to which they are bonded, contains a further hetero-atom in addition to the nitrogen atom, relevant compounds are in the main those of the formulae

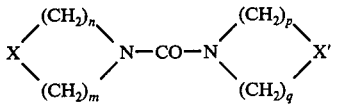

(4)

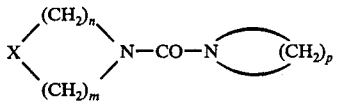

(5)

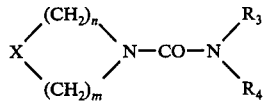

(6)

wherein X and X' each is an oxygen or sulphur atom or a —NR— group and R is a hydrogen atom or an alkyl radical, $R_3$ and $R_4$ have the abovementioned meaning and $n$, $m$, $p$ and $q$ represent positive integers which are small, and preferably $n$ and $m$, or $p$ and $q$, are equal to one another. Important compounds of the formulae 4 to 6 which should be mentioned are those which contain a 5-membered or 6-membered heterocyclic radical with one or two hetero-atoms, especially a radical of the formula 7

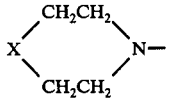

(7)

wherein X has the abovementioned meaning.

The following may be mentioned as examples of urea and thiourea derivatives: N-ethylurea, N-methylurea, N-methylthiourea, N,N'-ethyleneurea, N,N'-dimethylthiourea, 2-imidazolidone, thiourea, N,N'-propylenethiourea, N-isobutylthiourea and N,N-butylenethiourea.

Examples of amides which should be mentioned are above all those of the general formula $$R - CO - NH_2$$

wherein R denotes aryl, especially phenyl, aralkyl, especially benzyl, or a 5-membered or 6-membered saturated or unsaturated heterocyclic ring which can be substituted by halogen, especially chlorine or bromine, OH, CH, $NH_2$ or hydroxyalkyl ($C_1$–$C_3$), such as, for example, nicotinic acid amide, anthranilic acid amide, 3-aminobenzamide or pyrazinecarboxylic acid amide.

Examples of imides which should be mentioned are above all those of the general formula

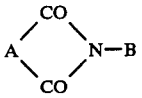

wherein A denotes the —CH=CH— or $(CH_2)_n$ group ($n$ = 1 to 6), which can contain halogen or OH, CN, $NH_2$ and hydroxyalkyl ($C_1$–$C_3$) as substituents, and B denotes —OH, —CN, —$NH_2$ or hydroxyalkyl ($C_1$–$C_4$), such as, for example, N-hydroxysuccinimide or N-hydroxymethylsuccinimide.

The following may be mentioned as further compounds, containing nitrogen, which can be used according to the invention: N-phenyldiethanolamine, bis-(2-hydroxypropyl)-amine and tri-(hydroxymethyl)-nitromethane. Further suitable compounds which can be used according to the invention are hydroxamic acids, substituted oximes and substituted aldehydes of the following general formulae 8–10

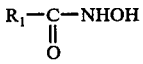

(8)

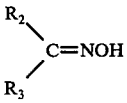

(9)

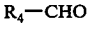

(10)

wherein $R_1$; $R_2$, $R_3$ and $R_4$ = alkyl and alkenyl ($C_1$–$C_{22}$); $CH_2$=CH—;

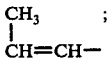

;

phenyl and alkyl($C_1$–$C_9$)-phenyl; benzyl; cyclohexyl; a heterocyclic saturated and/or unsaturated 5-membered or 6-membered ring with at least 1 group or 1 atom from amongst N, O, S, CO and NH in the ring; $R_1$, $R_2$, $R_3$ and $R_4$ can also be substituted by OH, CN, $NO_2$, alkoxy($C_1$–$C_4$), hydroxyalkyl($C_1$–$C_3$), $NH_2$ or Hal groups. Particular examples are benzhydroxamic acid, salicylaldoxime and 4-hydroxybenzaldehyde.

Finally, the following may be mentioned as nitrogen-free compounds which accord with the definition and can be used according to the invention: 2,6-dihydroxytoluene, resorcinol, glutaric anhydride, succinic anhydride, hydroquinone-bis-hydroxyethyl ether and pentaerythritol.

This does not exhaust the compounds which can be used according to the invention. The compounds listed as examples merely represent a selection of such substances, which correspond to the criterion "solid when applied to the auxiliary carrier, liquid during the transfer phase".

The compounds which accord with the definition and can be used according to the invention should furthermore be inert during the transfer printing process, that is to say they should neither influence the colour shade of the transferable dyestuffs nor their fastness properties, nor the properties of the fibres.

The proportion of compound according to the definition, or of compounds according to the definition, required to achieve optimum dyestuff uptake depends on the composition of the material to be printed. Whilst preferably about 100 to 300 g/kg of printing ink are used for pure cotton, an amount of 25 to 200 g/kg of printing ink already suffices for mixed fabrics containing 67% of polyester and 33% of cotton. The amount to be used also depends on the molecular size of the compounds according to the definition. Compounds of low molecular weight are frequently more effective than those having a large molecule.

For commercial reasons alone, compounds of low molecular weight will therefore be preferred. As a rule, the compounds usable according to the invention will have a molecular weight of less than 250.

Suitable dyestuffs for carrying out the process are those which pass into the vapour state at between 160 and 220° C, that is to say dyestuffs of which the vapour pressure at 160° C is above $10^{-5}$ mm Hg or dyestuffs which, at atmospheric pressure or under a vacuum of 2–150 mm Hg, pass into the vapour state to the extent of at least 60% in less than 60 seconds at between 160° and 220° C. In particular, they are organic cationic disperse dyestuffs, vat dyestuffs or pigment dyestuffs, or optical brighteners.

Above all, the dyestuffs usually employed for transfer printing on polyester and listed in the Colour Index under the heading "Disperse Dyestuffs" are suitable for the process according to the invention. These disperse dyestuffs can belong to a great diversity of categories, for example to the azo or anthraquinone series, but quinophthalone, nitro, azomethine and styryl dyestuffs and the like can also be used. Examples of such dyestuffs are to be found in the following patent specifications: French Patent Specifications 1,223,330, 1,334,829, 2,002,602 and 1,600,522, Swiss Patent Specification 476,893 and German Offenlegungsschrift 2,114,813. Furthermore, it is also possible to use transferable dyestuffs which are listed in the Colour Index under the heading Vat Dyestuffs and/or Organic Pigment Dyestuffs. These are dyestuffs which are less soluble in water than the disperse dyestuffs and are therefore not absorbed or only absorbed inadequately, that is to say to the extent of less than 50%, onto synthetic fibres from an aqueous dispersion. Such dyestuffs in general have a molecular weight of less than 700, preferably less than 300 to 400. The dyestuffs preferably contain methoxy, methylthio, ethoxy, isopropoxy, phenylthio, acetylamino, ethoxycarbonylamino or benzoylamino groups, or nitro, cyano or $C_1$–$C_4$-alkyl radicals.

The dyestuffs can belong, for example, to the following categories: indigoid, thioindigoid, anthraquinonoid, azo, azomethine or stilbene pigment dyestuffs; in particular, those of the azo, azomethine, stilbene or anthraquinone series are used. Examples which may be mentioned are 1-benzoylaminoanthraquinone and its substitution product, such as 1-benzoylamino-4-chloroanthraquinone and 1-benzoylamino-4-hydroxyanthraquinone, 4-nitroacridones having a substituted mercapto group, such as 1-naphthylthio-4-nitroacridone, or other examples of this category of compounds, described in DAS 1,794,317, thioindigo, anthanthrone and the dyestuffs of the formula

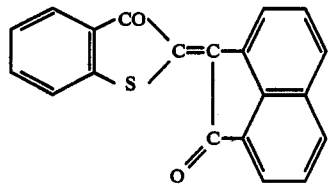

and

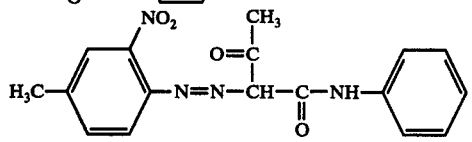

Hydrophilic fibre materials which can be used are above all woven fabrics and knitted fabrics, but also nonwovens of wool or of polyhydroxylic natural or synthetic fibre materials, especially cellulose, such as, for example, staple rayon, cotton and viscose, polyvinyl alcohol fibres and their mixtures with synthetic fibres, such as polyacrylonitrile and polyesters, especially mixtures of polyester and cotton, polyester and wool, polyacrylonitrile and wool, polyacrylonitrile and cotton or polyamide and cotton.

Synthetic fibre materials which can be used are above all woven fabrics, knitted fabrics or non-wovens of fibres, which may be, for example, in the form of webs or in a cut form or made-up form, but also films based on synthetic materials, such as, for example, materials made of acrylonitrile, for example polyacrylonitrile and copolymers of acrylonitrile and other vinyl compounds, such as acrylic esters, acrylamides, vinylpyridine, vinyl chloride or vinylidene chloride, copolymers of dicyanoethylene and vinyl acetate, and acrylonitrile block copolymers, materials consisting of polyvinyl chloride, of cellulose triacetate and of cellulose 2½ -acetate, and especially materials consisting of polyamides, such as polyamide-6, polyamide-6,6 or polyamide-12, and materials consisting of aromatic polyesters, such as those from terephthalic acid and ethylene glycol or 1,4-dimethylcyclohexane, and copolymers of terephthalic acid and isophthalic acid and ethylene glycol.

The inert temporary carrier or auxiliary carrier required for carrying out the process, that is to say a carrier which has no affinity to the substances usable according to the invention and to the dyestuffs or optical brighteners, is suitably a flexible, preferably dimensionally stable, sheet-like structure, such as a tape or strip or a film, advantageously having a smooth surface, which is heatstable and can consist of a great diversity of, above all, non-textile materials, for example metal, such as aluminium foil or steel foil, or an endless belt of stainless steel or strip of plastic or paper, preferably pure non-lacquered cellulose parchment paper, which can optionally be coated with a film of vinyl resin, ethylcellulose, polyurethane resin or Teflon.

A particular embodiment of the transfer printing process comprises only applying cut pieces of the print carrier, instead of a continuous web, onto the particle to be printed. Such cut pieces can represent various forms of pattern, such as letters, flowers, comic pictures and the like.

The process according to the invention can, for example, be carried out as follows: printing inks which contain at least one transferable dyestuff or optical brightener, at least one solid compound which melts in the course of the heat exposure of the transfer printing process and has a vapour pressure above $10^{-5}$ mm Hg at 150° to 250° C, optionally a binder which is stable below 230° C, water and/or an organic solvent are applied to an inert carrier and dried; the treated side of the carrier is then brought into contact with the surface of the material to be printed, after which the carrier and the material to be printed are subjected, if appropriate under mechanical pressure, to heat exposure at 100° to 250° C, advantageously 170° to 220° C, for 3 to 60 seconds, advantageously 3 to 30 seconds, and the printed material is then separated from the carrier. Very good results are also obtained if the transfer is carried out under a vacuum of, preferably, 2 to 150 mm Hg. In that case, very short transfer times of about 3 to 15 seconds at temperatures of 130° to 200° C suffice.

A particular embodiment of the process according to the invention is that the carrier is first printed with a printing ink without addition of the compound or compounds according to the definition and is dried, and then coated with a corresponding printing ink which in addition to a binder solely contains the compound according to the definition, and dried. If dispersions are used, the dyestuffs dispersed in the printing ink should in the main have a particle size of $\leqq 10\ \mu$, preferably $\leqq 2\ \mu$.

In addition to water it is possible to use, for the preparation of the printing ink, practically all water-miscible and water-immiscible organic solvents or solvent mixtures which boil at temperatures below 220° C, preferably below 150° C, under atmospheric pressure and in which the dyestuffs and binders to be used exhibit sufficient solubility or emulsifiability (dispersibility). The following may be mentioned as examples of usable organic solvents: aliphatic and aromatic hydrocarbons, for example n-heptane, cyclohexane, petroleum ether, benzene, xylene or toluene, halogenated hydrocarbons, such as methylene chloride, trichloroethylene, perchloroethylene or chlorobenzene, nitrated aliphatic hydrocarbons, such as nitropropanes, aliphatic amides, such as dimethylformamide or their mixtures, and also glycols, such as ethylene glycol or ethylene glycol monoalkyl ethers, such as ethylene glycol monoethyl ether, diethyl carbonate, dimethyl carbonate or esters of aliphatic monocarboxylic acids, such as ethyl acetate, propyl acetate, butyl acetate and $\beta$-ethoxyethyl acetate, aliphatic or cycloaliphatic ketones, for example methyl ethyl ketone, methyl isobutyl ketone, cyclohexanone, isophorone, mesityl oxide or diacetone-alcohol, and alcohols, such as methanol, ethanol and preferably n-propanol, iso-propanol, n-butanol, tert.butanol, sec.-butanol or benzyl alcohol; mixtures of the solvents mentioned, such as, for example, a mixture of methyl ethyl ketone and ethanol in the ratio of 1:1, can also be used.

Particularly preferred solvents are esters, ketones or alcohols which boil below 120° C, such as butyl acetate, acetone, methyl ethyl ketone, ethanol, iso-propanol or butanol. It is advantageous to use practically anhydrous printing inks.

The desired viscosity of the printing inks can be adjusted by adding binder or by dilution with water or a suitable solvent.

Suitable binders are synthetic, semi-synthetic and natural resins, including both polymerisation products and polycondensation and polyaddition products. In principle, all resins and binders customary in the lacquer and printing ink industry can be used. The binders should not melt at the transfer temperature, should not react chemically with air or with themselves (for example crosslink), should exhibit little or no affinity to the dyestuffs used, should solely hold the transferable dyestuffs or optical brighteners in the printed area of the inert carrier, without modifying them, and should remain completely on the carrier after the thermal transfer process. Binders which are soluble in organic solvents and which, for example, dry rapidly in a stream of warm air and form a fine film on the carrier, are preferred. The following may be mentioned as suitable water-soluble binders: alginate, tragacanth, carubin (from carob bean flour), dextrin, vegetable mucilages etherified or esterified to a greater or lesser degree, hydroxyethylcellulose or carboxymethylcellulose, water-soluble polyacrylamides or, above all, polyvinyl alcohol, whilst suitable binders soluble in organic solvents are cellulose esters, such as nitrocellulose, cellulose acetate or cellulose butyrate, and especially cellulose ethers, such as methylcellulose, ethylcellulose, propylcellulose, isopropylcellulose, benzylcellulose, hydroxypropylcellulose or cyanoethylcellulose, and also their mixtures.

To improve the usability of the printing inks it is possible to add optional components such as plasticisers, high-boiling solvents, such as, for example, tetralin or decalin, and ionic or non-ionic surface-active compounds, such as, for example, the condensation product of 1 mol of octylphenol with 8 to 10 mols of ethylene oxide.

The liquid, pasty or dry dyeing preparations according to the invention in general contain 0.01 to 80, preferably 1 to 30, percent by weight of at least one or more transferable dyestuffs or optical brighteners and, within the same weight limits, at least one of the compounds which accord with the definition and can be used according to the invention, and optionally 0.5 to 50 percent by weight of a binder, relative to the total weight of the preparation, and can be employed, directly or after dilution, as a printing ink which can be used according to the invention.

The printing inks, which are filtered if necessary, are applied to the inert carrier, for example by spraying locally or over the entire area, by coating or, suitably, by printing. It is also possible to apply a multi-colour pattern to the inert carrier or to print it successively in a ground colour and subsequently with identical or different patterns.

After applying the printing inks to the inert carrier, the inks are dried, for example with the aid of a stream of warm air or by infra-red radiation, if appropriate with recovery of the solvent used.

The intermediate carriers can also be printed on both sides, in which case different colours and/or patterns can be chosen for the two sides. To avoid the use of a printing machine it is possible to spray the printing inks onto the auxiliary carrier, for example by means of a spray gun. Particularly interesting effects are obtained if more than one shade is printed or sprayed simultaneously onto the auxiliary carrier. In doing so it is possible to obtain certain patterns, for example by using stencils, or to produce artistic patterns with a paintbrush. If the auxiliary carriers are being printed, a great diversity of printing processes can be used, such as relief printing processes (for example letterpress printing or flexographic printing), gravure printing processes (for example roller printing), screen printing processes (for example rotary screen printing or film printing) or electrostatic printing processes.

The transfer is effected in the usual manner by the action of heat. For this purpose, the treated auxiliary carriers are brought into contact with the textile materials and kept at 100° to 250° C until the transferable dyestuffs or optical brighteners applied to the auxiliary carrier have been transfered to the textile material. As a rule, 3 to 60 seconds suffice for this purpose.

The heat exposure can be effected in various known ways, for example by passing through a hot heating drum or a tunnel-shaped heating zone, or by means of a heated roller, advantageously in the presence of an unheated or heated backing roller which exerts pressure, or by means of a hot calender or by means of a heated plate (clothes iron or warm press), if appropriate under vacuum, the heating devices being pre-heated to the requisite temperature by steam, oil, infra-red radiation or microwaves or being located in a pre-warmed heating chamber.

After completion of the heat treatment, the printed goods are separated from the carrier.

The process according to the invention has notable advantages over known processes. In particular, the present process has the main advantage that the problem of achieving deep and fast dyeings and prints on hydrophilic fibre material and synthetic fibre material and their mixtures by the thermal transfer process, whilst preserving optimum mechanical properties of the fibres, has now largely been solved. The prints obtainable in accordance with the new process are distinguished by sharp, finely outlined contours. A pre-treatment of the substrate being printed or dyed is not necessary. However, the greatest advantage of the new process is that it is possible to print or dye mixed woven fabrics or mixed knitted fabrics of natural or synthetic fibre materials with fully synthetic fibres tone-in-tone, which was not possible hitherto by thermal transfer printing methods, using a monofunctional transfer auxiliary.

In the examples which follow and do not limit the invention, the parts and percentages are by weight.

EXAMPLE 1

(a) 5 parts of the dyestuff of the formula

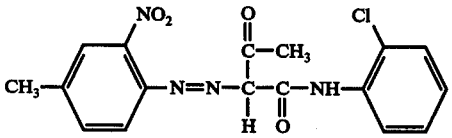

6.4 parts of ethylcellulose (Ethocel E 7, Dow Chem), 58.6 parts of ethanol and 30 parts of N-hydroxysuccinimide are ground for 2 hours in a sand mill, whilst cooling. After separating the sand from the ground material, a printing ink with very good fine division of the dyestuff is obtained. The resulting printing ink is printed onto paper and a temporary carrier paper suitable for the transfer printing process is obtained.

(b) A mixed fabric of polyester and cotton (67/33) is placed on the temporary carrier pre-treated as above, after which the carrier and the fabric are brought into contact for 30 seconds at 215° C by means of a heated heating plate. A second plate, which is not warmed, ensures uniform contact. Thereafter, the dyed mixed fabric is separated from the carrier.

A deep yellow print coloured tone-in-tone, and exhibiting good fastness to wet processing and rubbing, is thus obtained on the polyester/cotton mixed fabric.

If the procedure described in the above example is followed but a printing ink without added N-hydroxysuccinimide is used, a tippy dyeing is obtained, since only the polyester constituent of the mixed fabric is dyed whilst the cotton constituent remains white.

EXAMPLE 2

Deep prints coloured tone-in-tone are also obtained with the following dyestuffs, on mixed fabrics of polyester and cotton (67/33), in accordance with the same process as that described in Example 1.

a)

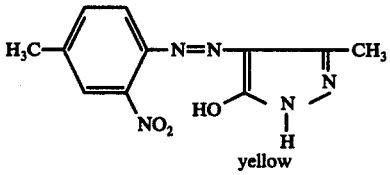

yellow b)

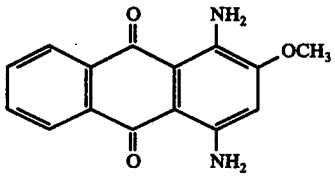

violet c)

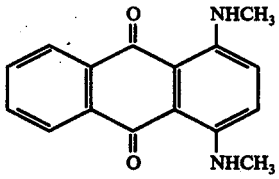

blue d)

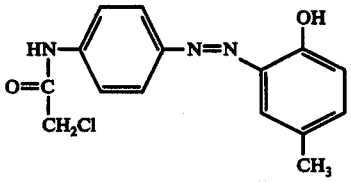

yellow e)

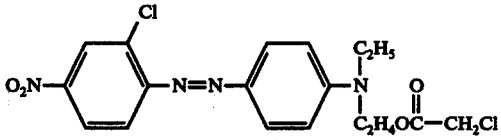

red f)

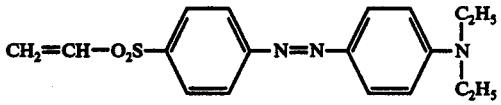

orange g)

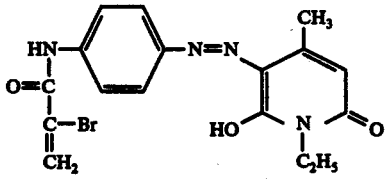

yellow

-continued h)

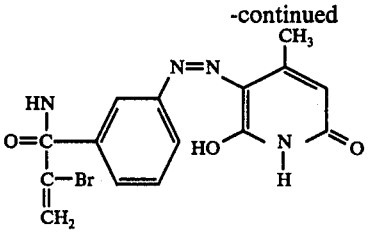

greenish-tinged yellow

EXAMPLE 3

A temporary carrier paper is produced with the dyestuff of the formula

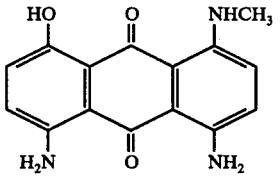

analogously to Example 1*a*) and the dyestuff is transferred onto a cotton fabric analogously to Example 1*b*).

A deep blue print of good fastness to rubbing is obtained on the cotton fabric.

EXAMPLE 4

A temporary carrier paper is produced with the dyestuff of the formula

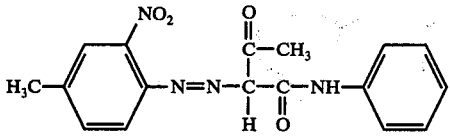

or the dyestuff of the formula

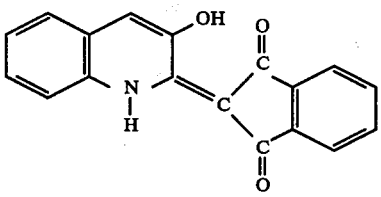

analogously to Example 1*a*), and the dyestuff is transferred analogously to Example 1*b*) onto a mixed fabric of polyester and cotton (67/33).

In each case a deep yellow tone-in-tone dyeing is obtained on the mixed fabric.

EXAMPLE 5

(a) 5 parts of the dyestuff of the formula

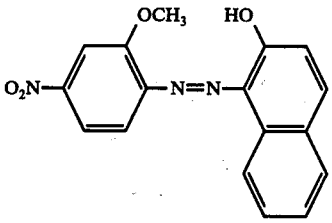

6.4 parts of ethylcellulose (Ethocel E 7, Dow Chem.) and 88.6 parts of ethanol are ground for 2 hours in a sand mill, whilst cooling. After separating the sand from the ground material, a printing ink with very good fine distribution of the dyestuff is obtained. The resulting printing ink is printed onto paper and dried.

(b) 30 parts of N-hydroxysuccinimide, 6.4 parts of ethylcellulose and 63.6 parts of ethanol are ground for 2 hours in a sand mill, whilst cooling. After separating off the sand, a printing ink with very good distribution of the N-hydroxysuccinimide is obtained. The resulting ink is applied over the entire surface of the paper prepared under a), and dried. A temporary carrier paper suitable for the transfer printing process is obtained.

(c) A mixed fabric of polyester and cotton (67/33) is placed on the temporary carrier pre-treated in this way, after which the carrier and fabric are brought into contact for 30 seconds at 215° C by means of a heated heating plate. A second, insulated plate which is not warmed ensures uniform contact. Thereafter, the dyed mixed fabric is separated from the carrier.

A deep scarlet-coloured tone-in-tone print is thus obtained on the polyester/cotton mixed fabric.

If the procedure followed is as described in the above example but the printing ink prepared under b) is omitted, a tippy dyeing is obtained since only the polyester constituent of the mixed fabric is dyed whilst the cotton constituent remains white.

If the procedure described in Example 5 is followed but instead of N-hydroxysuccinimide corresponding amounts of one of the compounds shown below are used to prepare the ink as under 5*b*), tone-in-tone dyeings of similar fastness properties are again obtained on polyester/cotton (67/33).

| Example No. | |
|---|---|
| 6 | N-methylurea |
| 7 | N,N'-dimethylurea |
| 8 | acetamide |
| 9 | thiourea |

EXAMPLE 10

If the procedure described in Example 5 is followed but corresponding amounts of the dyestuff of the formula

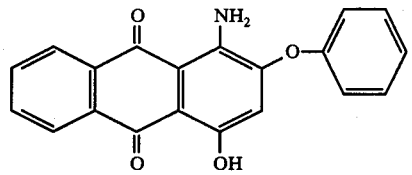

are used as the dyestuff and corresponding amounts of one of the compounds shown below are used instead of N-hydroxysuccinimide

| | |
|---|---|
| 10 | nicotinic acid amide |
| 11 | succinimide |
| 12 | N-methylthiourea |
| 13 | N-etylurea |
| 14 | N,N'-ethyleneurea |
| 15 | anthranilic acid amide |
| 16 | 3-aminobenzamide |
| 17 | resorcinol |
| 18 | N-methylurea |
| 19 | glutaric anhydride |

-continued

| | |
|---|---|
| 20 | urea |

and the transfer is carried out for 30 seconds at 195° C, a deep red print coloured tone-in-tone is obtained on the cotton/polyester mixed fabric.

EXAMPLE 21

If the procedure followed is as described in Example 5 but corresponding amounts of the dyestuff of the formula

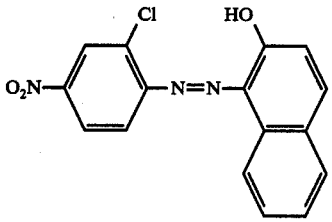

are used as the dyestuff and corresponding amounts of nicotinic acid amide are used instead of N-hydroxysuccinimide, a deep orange tone-in-tone dyeing is obtained on a mixed fabric of polyester and wool (50/50).

EXAMPLE 22

If the procedure followed is as described in Example 21 but corresponding amounts of the dyestuff of the formula

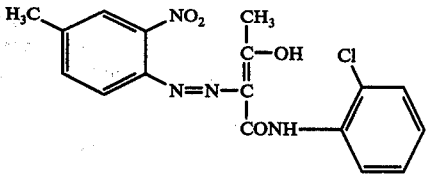

are used as the dyestuff, and in other respects the same method as described in the example is used, a deep yellow tone-in-tone dyeing is obtained on polyester/cotton (67/33) and polyester/wool.

If the procedure followed is as described in Example 22 but a cotton fabric is used as a print substrate, a deep yellow print is obtained.

If a temporary carrier which is not coated with N-hydroxysuccinimide is used, practically no dyeing of the cotton fabric results.

EXAMPLE 23

A temporary carrier is produced analogously to Example 5*a*) from an aluminum foil and the dyestuff of the formula

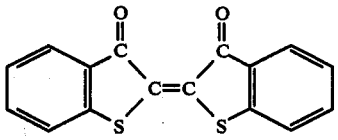

and is top-coated with a printing ink analogously to Example 5*b*). The transfer onto a mixed fabric of polyester and cotton (67/33) is then carried out analogously to Example 5*c*), but at 165° C and under a vacuum of 100 mm Hg, for 10 seconds.

A pink print coloured tone-in-tone and exhibiting good general fastness properties is thus obtained on the mixed fabric.

EXAMPLE 24

0.5 part of the optical brightener of the formula

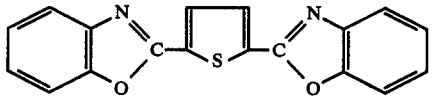

is compounded in a sand mill analogously to Example 5*a*), applied to a temporary carrier paper suitable for the transfer printing process and top-coated, analogously to Example 5*b*), with a second printing ink, containing the transfer agent, but using N,N-ethyleneurea instead of N-hydroxysuccinimide.

The brightener is transferred from the resulting temporary carrier paper onto cotton fabric on an ironing press over the course of 30 seconds at 160° C.

A marked brightening is thus produced on the cotton fabric. If the procedure described in Example 24 is followed but a printing ink without added N,N-ethyleneurea is used, no brightening effect is produced on the cotton fabric.

EXAMPLE 25

(a) A temporary carrier paper is printed with an aqueous printing ink, containing 15 g/kg of a preparation which contains 48% of the pigment of the formula

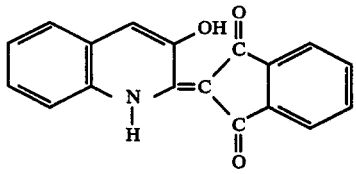

and is dried.

(b) 25 parts of nicotinic acid amide, 5.25 parts of ethylcellulose and 69.75 parts of ethanol are ground for 2 hours in a glass bead mill, whilst cooling. After separating the glass beads from the ground material, a printing ink showing very good fine distribution of the nicotinic acid amide is obtained. The resulting printing ink is applied over the whole surface of the temporary carrier paper which has been printed as under a), and is dried. A temporary carrier paper suitable for the transfer printing process is thus obtained.

(c) A mixed fabric of polyester and cotton (67/33) is placed on the temporary carrier pre-treated in this way, after which the carrier and fabric are brought into contact by means of a heated heating plate, applied to the paper side, by being lightly pressed together for 30 seconds at 210° C. A second, insulated plate at the same time provides a uniform counter-pressure. The dyed mixed fabric is then separated from the temporary carrier. A deep yellow print is thus obtained on the polyester/cotton mixed fabric.

What we claim is:

1. In a transfer printing process for the dyeing or optical brightening of hydrophilic fiber material, synthetic fiber material or mixtures thereof which comprises bringing a treated and dried surface of a temporary carrier into contact with the dry surface of the material to be dyed or optically brightened, applying heat sufficient to effect transfer of dyestuff or optical brightener from the temporary carrier to the material to be dyed or optically brightened, and separating the said material from the temporary carrier, the improvement according to which the temporary carrier comprises a flexible, dimensionally stable, heat stable, sheet-like base having on at least a portion of the surface thereof at least one sublimable dyestuff or optical brightener, a binder which is stable at temperatures below 230° C and at least one solid compound which melts during the heat exposure step of the transfer process and which has a vapor pressure above $10^{-5}$ mm Hg at 150 to 250° C, said solid compound being inert during the transfer printing process and being selected from the group consisting of amides, imides, unsubstituted and substituted ureas and thioureas and 5- or 6- membered saturated or unsaturated heterocyclic ring compound which possess at least one of the groups or atoms N, S, O, NH, CO, =CH or $CH_2$ as members and which compound is unsubstituted or substituted by a member from the group of alkyl ($C_1$ - $C_4$), OH, $NH_2$, hydroxyalkyl ($C_1$ - $C_3$) and halogen.

2. A process according to claim 1, wherein the base of the temporary carrier is first printed with a printing ink which contains at least one transferable dyestuff or optical brightener, and dried, and then top-coated with a printing ink which contains at least one solid compound as defined in claim 1.

3. A process according to claim 1, wherein the said solid compound contains at least one nitrogen atom in the molecule.

4. A process according to claim 1, wherein the said solid compound is a member selected from the group consisting of imidazole, 2-methylimidazole, hydantoin, 1-N-hydroxymethyl-5-dimethylhydantoin, succinimide, N-hydroxysuccinimide, nicotinic acid amide and pyrazinecarboxylic acid amide.

5. A process according to claim 1, wherein the said solid compound is of the formula

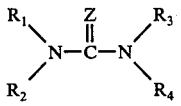

wherein Z is O or S and $R_1$, $R_2$, $R_3$ and $R_4$ independently of one another denote H, alkyl ($C_1$ - $C_8$), cycloalkyl or aryl, said groups being unsubstituted or substituted by OH, CN, $NH_2$, halogen or hydroxyalkyl ($C_1$ - $C_3$), or $R_1$ and $R_2$, or $R_3$ and $R_4$, together with the bridge member —N—CZ—N—, to which they are bonded, form a heterocyclic ring which may contain further heteroatoms selected from the group of oxygen, sulphur and nitrogen atoms.

6. A process according to claim 5, wherein the said solid compound is a member selected from the group consisting of N-ethylurea, N-methylurea, N-methylthiourea, N,N'-ethyleneurea, N,N'-dimethylthiourea, 2-imidazolidone, thiourea, N,N'-propylenethiourea, N-isobutylthiourea and N,N-butylenethiourea.

7. A process according to claim 1, wherein the said solid compound is of the formula $$R - CO - NH_2$$

wherein R denotes aryl, arylkyl, or a 5-membered or 6-membered saturated or unsaturated heterocyclic ring which is unsubstituted or is substituted by halogen, OH, CN, $NH_2$ or hydroxyalkyl ($C_1$ - $C_3$).

8. A process according to claim 1, wherein the said solid compound is the formula

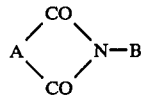

wherein A denotes the —CH=CH— or $(CH_2)_n$ group wherein $n$ is an integer of 1 to 6, said group being unsubstituted or substituted by halogen, OH, CN, $NH_2$ or hydroxyalkyl ($C_1$ - $C_3$), and B denotes —OH, —CN, —$NH_2$ or hydroxyalkyl ($C_1$ - $C_4$).

9. A process according to claim 8, wherein the said solid compound is N-hydroxysuccinimide or N-hydroxymethylsuccinimide.

10. A process according to claim 1, wherein the said solid compound is a compound selected from those of the formulae

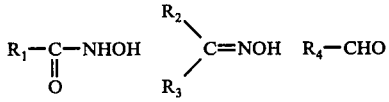

wherein $R_1$, $R_2$, $R_3$ and $R_4$ are selected from the group of alkyl, alkenyl ($C_1$ - $C_{22}$),

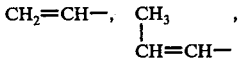

phenyl, alkyl ($C_1$ - $C_9$)-phenyl, benzyl, cyclohexyl; a heterocyclic saturated or unsaturated 5-membered or 6-membered ring with at least one member of the group consisting of N, O, S, CO and NH in the ring, $R_1$, $R_2$, $R_3$ and $R_4$ being unsubstituted or substituted by OH, CN, $NO_2$, alkoxy ($C_1$ - $C_4$), hydroxyalkyl ($C_1$ - $C_3$) or Hal.

11. A process according to claim 1 wherein the sublimable dyestuff has a vapor pressure at 160° C of above $10^{-5}$ mm Hg or which, at atmospheric pressure or under a vacuum of 2–150 mm Hg passes into the vapor state to the extent of at least 60% in less than 60 seconds at between 160° and 220° C.

12. A process according to claim 11, wherein a disperse dyestuff or optical brightener which under atmospheric pressure passes into the vapor state to the extent of at least 60% in less than 60 seconds at between 160° and 220° C is used.

13. A process according to claim 11, wherein a transferable vat dyestuff or pigment dyestuff of molecular weight below 700 is used, of which the vapour pressure under atmospheric pressure at 160° C is above $10^{-5}$ mm Hg.

14. A process according to claim 1, wherein wool, cotton or mixtures of polyester and cotton are used as the fiber material to be printed.

15. A process according to claim 1, wherein the temporary carrier and the material to be dyed or optically brightened are subjected to a heat exposure at 170° to 220° C for 10 to 40 seconds.

16. A process according to claim 1, wherein the temporary carrier and the material to be dyed or optically brightened are subjected to a heat exposure at 130° to 200° C for 3 to 30 seconds under a vacuum of 30 to 150 mm Hg.

17. In a printing ink composition useful in the printing of temporary carriers for use in the transfer printing process, said composition comprising water, organic solvent or mixtures thereof having dissolved or dispersed therein at least one sublimable dyestuff or optical brightener and a binder which is stable below 230° C.

the improvement wherein the composition contains at least one solid compound which melts during the heat exposure step of the transfer printing process and which has a vapor pressure above $10^{-5}$ mm Hg at temperatures of 150° to 250° C, said solid compound being inert during the transfer printing process and being selected from the group consisting of amides, imides, unsubstituted and substituted ureas and thioureas and 5- or 6-membered saturated or unsaturated heterocyclic ring compounds which possess at least one of the groups or atoms N, S, O, NH, CO, =CH or $CH_2$ as members and which compound is unsubstituted or substituted by a member from the group of alkyl ($C_1$ - $C_4$), OH, $NH_2$, hydroxyalkyl ($C_1$ - $C_3$) and halogen.

18. In a temporary carrier for use in the transfer printing process the improvement wherein said carrier comprises a flexible, dimensionally stable, heat stable sheet-like base having on at least a portion of the surface thereof at least one sublimable dyestuff or optical brightener, a binder which is stable at temperatures below 230° C and at least one solid compound which melts during the heat exposure step of the transfer process and which has a vapor pressure above $10^{-5}$ mm Hg at 150° to 250° C, said solid compound being inert during the transfer printing process and being selected from the group consisting of amides, imides, unsubstituted and substituted ureas and thioureas and 5- or 6-membered saturated or unsaturated heterocyclic ring compounds which possess at least one of the groups or atoms N, S, NH, CO, =CH or $CH_2$ as members and which compound is unsubstituted or substituted by a member from the group of alkyl ($C_1$ - $C_4$), OH, $NH_2$, hydroxyalkyl ($C_1$ - $C_3$) and halogen.

19. A temporary carrier according to claim 18, wherein the base consists of paper.

20. A temporary carrier according to claim 18, comprising loose cut pieces having various pattern shapes.

21. A temporary carrier according to claim 18, wherein the binder is a cellulose ether or cellulose ester.

22. A temporary carrier according to claim 18 wherein the binder is polyvinyl alcohol.

* * * * *